US006304334B1

(12) United States Patent
Ueno

(10) Patent No.: US 6,304,334 B1
(45) **Date of Patent: *Oct. 16, 2001**

(54) SYSTEM FOR PERFORMING INITIALIZATION SEQUENCES DEPENDING ON STATUS OF IMAGE FORMING APPARATUS

(75) Inventor: Fumihiro Ueno, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/661,383

(22) Filed: Jun. 11, 1996

(30) Foreign Application Priority Data

Jun. 14, 1995 (JP) ..... 7-147759

(51) Int. Cl.[7] ..... B41B 1/00

(52) U.S. Cl. ..... 358/1.13; 358/1.2; 358/1.9; 358/1.14

(58) Field of Search ..... 395/112, 113, 395/101, 652, 182.01; 347/139, 140, 158; 399/42, 25, 26, 116, 117, 119, 70, 13; 101/113; 358/1.16, 1.13, 1.14, 1.1, 1.2, 1.6, 1.9, 1.15, 1.17, 1.18; 713/2; 714/3

(56) References Cited

U.S. PATENT DOCUMENTS

| | | | | |
|---|---|---|---|---|
| 4,347,506 | * | 8/1982 | Duwel et al. | 340/679 |
| 4,653,886 | * | 3/1987 | Desourmeaux | 396/390 |
| 4,751,484 | * | 6/1988 | Matsumoto et al. | 399/25 |
| 4,881,101 | * | 11/1989 | Sumida | 399/82 |
| 4,996,567 | * | 2/1991 | Watarai | 399/70 |
| 5,055,881 | * | 10/1991 | Fukuchi | 399/13 |
| 5,151,740 | * | 9/1992 | Fujimoto | 399/59 |
| 5,155,527 | * | 10/1992 | Gokita et al. | 399/29 |
| 5,182,600 | * | 1/1993 | Hasegawa et al. | 399/74 |
| 5,194,897 | * | 3/1993 | Yoshiyama et al. | 355/215 |
| 5,220,379 | * | 6/1993 | Fukuchi et al. | 399/25 |
| 5,258,248 | * | 11/1993 | Tokuhashi et al. | 430/31 |
| 5,327,209 | * | 7/1994 | Sasanuma et al. | 399/39 |
| 5,414,531 | * | 5/1995 | Amemiya et al. | 358/465 |
| 5,499,370 | * | 3/1996 | Hosaka et al. | 395/650 |
| 5,708,899 | * | 1/1998 | O'Leary et al. | 396/379 |
| 5,760,812 | * | 6/1998 | Hopkins | 347/158 |

FOREIGN PATENT DOCUMENTS

| | | | |
|---|---|---|---|
| 2234177 | * | 9/1990 | (JP) . |
| 06208263 | * | 7/1994 | (JP) . |

* cited by examiner

*Primary Examiner*—Dov Popovici
(74) *Attorney, Agent, or Firm*—Fitzpatrick, Cella, Harper & Scinto

(57) ABSTRACT

An image forming apparatus is constructed by a latent image forming unit for forming a latent image onto a photosensitive material, a developer for developing the latent image formed on the photosensitive material, a first detecting unit for detecting whether the photosensitive material or developer has been mounted in the image forming apparatus or not, a second detecting unit, provided for the image forming apparatus, for detecting an open or closed state of a door, and a control unit for selecting a specific item of an initial sequence from items of a plurality of initial sequences on the basis of an output of the first detecting unit when it is detected by the second detecting unit that the door was closed from the open state, thereby allowing the selected item to be executed. The plurality of items of initial sequences are items of initial sequences which are executed when a power source is supplied to the image forming apparatus.

16 Claims, 11 Drawing Sheets

FIG. 3

| KIND / PROCESS ITEMS | INITIAL SEQUENCE PROCEDURE 1 | INITIAL SEQUENCE PROCEDURE 2 | INITIAL SEQUENCE PROCEDURE 3 | INITIAL SEQUENCE PROCEDURE 4 | INITIAL SEQUENCE PROCEDURE 5 | INITIAL SEQUENCE PROCEDURE 6 |
|---|---|---|---|---|---|---|
| ALL RAM AREA CLEAR EXEECUTION | × | × | ○ | × | × | × |
| OFF TIME MEASUREMENT EXECUTION | × | × | ○ | × | × | × |
| INITIAL DEVELOPER PRESENT/ABSENT CHECK DRIVE | ○ | × | ○ | × | × | × |
| INITIAL SLEEVE DRIVE | ○ | × | ○ | × | ○ | ○ |
| INITIAL PHOTOSENSITIVE DRUM PRESENT/ABSENT CHECK DRIVE | ○ | ○ | ○ | × | × | × |
| INITIAL WEB DRIVE | ○ | ○ | ○ | × | × | × |
| EXECUTION OF INITIAL FROM SKIP WAIT STATE | × | × | × | ○ | × | × |
| IMAGE DENSITY Dmax CONTROL EXECUTION | ○ | × | ○ | × | × | × |
| IMAGE DENSITY HALFTONE CONTROL EXECUTION | ○ | × | ○ | × | ○ | × |

SYSTEM FOR PERFORMING INITIALIZATION SEQUENCES DEPENDING ON STATUS OF IMAGE FORMING APPARATUS

BACKGROUND OF THE INVENTION

1. Field of the Invention

The present invention relates to a n execution of an initial sequence of an image forming apparatus.

2. Related Background Art

As one of image forming apparatuses, a color printer for forming a multi-color image by repeating a recording cycle of a plurality of color components has been known. FIG. 10 shows an example of a control mechanism of such a color printer.

In FIG. 10, reference numeral 1 denotes a printer control circuit in which a video signal (VDo) 3 is form ed by an image forming control circuit 2 on the basis of an image signal of each color from a printer controller 11 and is outputted to a driving circuit 4. The driving circuit 4 is a circuit for driving a semiconductor laser (not sown) and generates a laser driving signal 5. The image forming control circuit 2 generates a video signal formed from the image signal of each color, allows an electrostatic latent image to be formed onto an image holding member (not shown), and outputs an activating signal 6 to a bias control circuit 7. High-voltage bias (transfer, development, etc.) information based on the use environment of the apparatus and the image signal of each color from the printer controller 11 has been stored in a storage circuit 10. The bias control circuit 7 uses bias data in the storage circuit 10 and generates a corresponding bias signal 8. Thus, the electrostatic latent image is developed and transferred onto a recording paper, thereby forming a multi-color image.

A detecting circuit 13D informs the image forming control circuit 2 of development cartridge present/absent information 14 or the like from a sensor provided for, for example, a developing device (not shown). An initial sequence control circuit 20D allows the image forming control circuit 2 to execute an initial sequence in accordance with a turn-on of a power source or an operation to open a door of the printer or the like. Further, the information obtained by the detecting circuit 13D is notified as information to form an image to the printer controller 11 through a video interface (I/F) 18.

FIG. 11 shows an initial sequence procedure in a door-open state by the initial sequence control circuit 20D. As shown in the diagram, a check is made in step S10 to see if the door is open. If YES, a door open initial sequence procedure is selected (step S21), the apparatus waits until the door is closed (step S14), and the processing routine is finished. As mentioned above, a predetermined door open initial sequence procedure is executed as an initial sequence process according to the door open/closed state. On the other hand, at the time of the initial process by the turn-on of a power source, a power-ON initial sequence procedure (not shown) which has separately been predetermined is executed.

There is a difference between the two initial sequence procedures mentioned above with respect to a point that, although the initialization is performed to the whole area in an RAM in the power-ON state, the initialization is performed to only a part of the area in the RAM in the door open state (data in the other area is held as it is at the preceding time). This is because in the initial sequence procedure, the RAM area to be cleared when the power is ON is made different from that when the door is open, thereby making it unnecessary to purposely reset a command which is needed at the time of the initial process and reducing the processing time.

However, as initial processes to be actually executed, in addition to the above-mentioned initial process in the power-ON state and initial process in the door open state, there are a detecting process about the presence or absence of a development cartridge or a photosensitive drum, a maximum image density (Dmax) control process, an image density halftone control process, and the like. Since the above processes are always executed when the door open/closed state is confirmed, it takes at least 100 seconds or more as a time which is required for all of the initial processes. Therefore, there is a problem such that even when the door is opened or closed for a mere jam process or the like, a predetermined initial processing time is needed.

SUMMARY OF THE INVENTION

It is an object of the invention to provide an image forming apparatus and its control method in which the above-mentioned drawbacks are eliminated.

Another object of the invention is to provide an image forming apparatus and its control method in which the optimum initial sequence can be selected in accordance with a loading state of a detachable processing member of an image forming apparatus and a time which is required for initial processes can be reduced.

Further another object of the invention is to provide an image forming apparatus and its control method in which an initial sequence according to a life detection of a processing member of an image forming apparatus is executed, thereby maintaining a picture quality and reducing a time which is required for initial processes.

The above and other objects and features of the present invention will become apparent from the following detailed description and the appended claims with reference to the accompanying drawings.

BRIEF DESCRIPTION OF THE DRAWINGS

FIG. 3 is a diagram showing each initial sequence procedure;

DETAILED DESCRIPTION OF THE PREFERRED EMBODIMENTS

Each embodiment of the invention will now be described hereinbelow with reference to the drawings.

Embodiment 1

Figure 1:
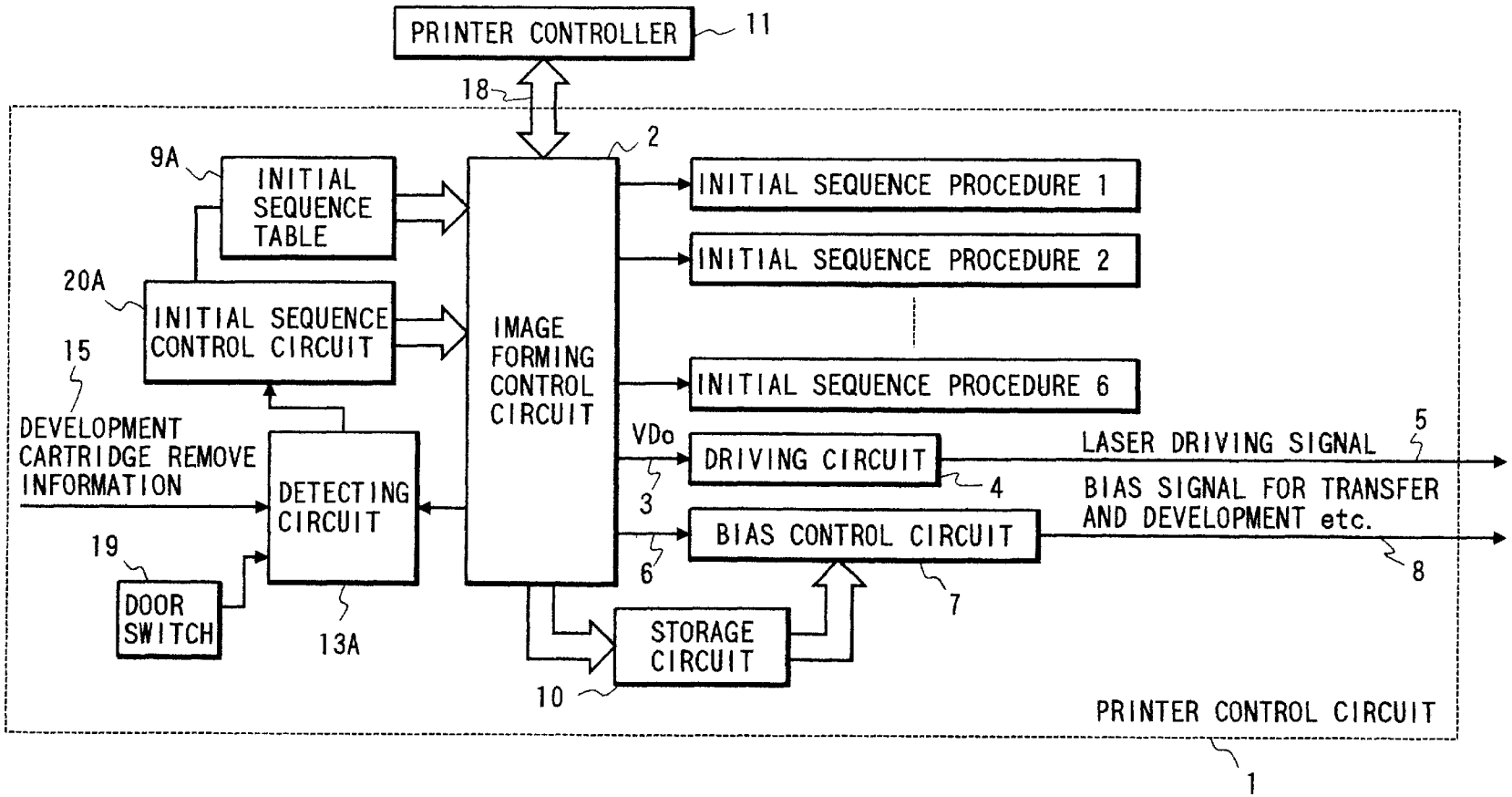
FIG. 1 is a block diagram showing the first embodiment of the present invention.
Figure 10:
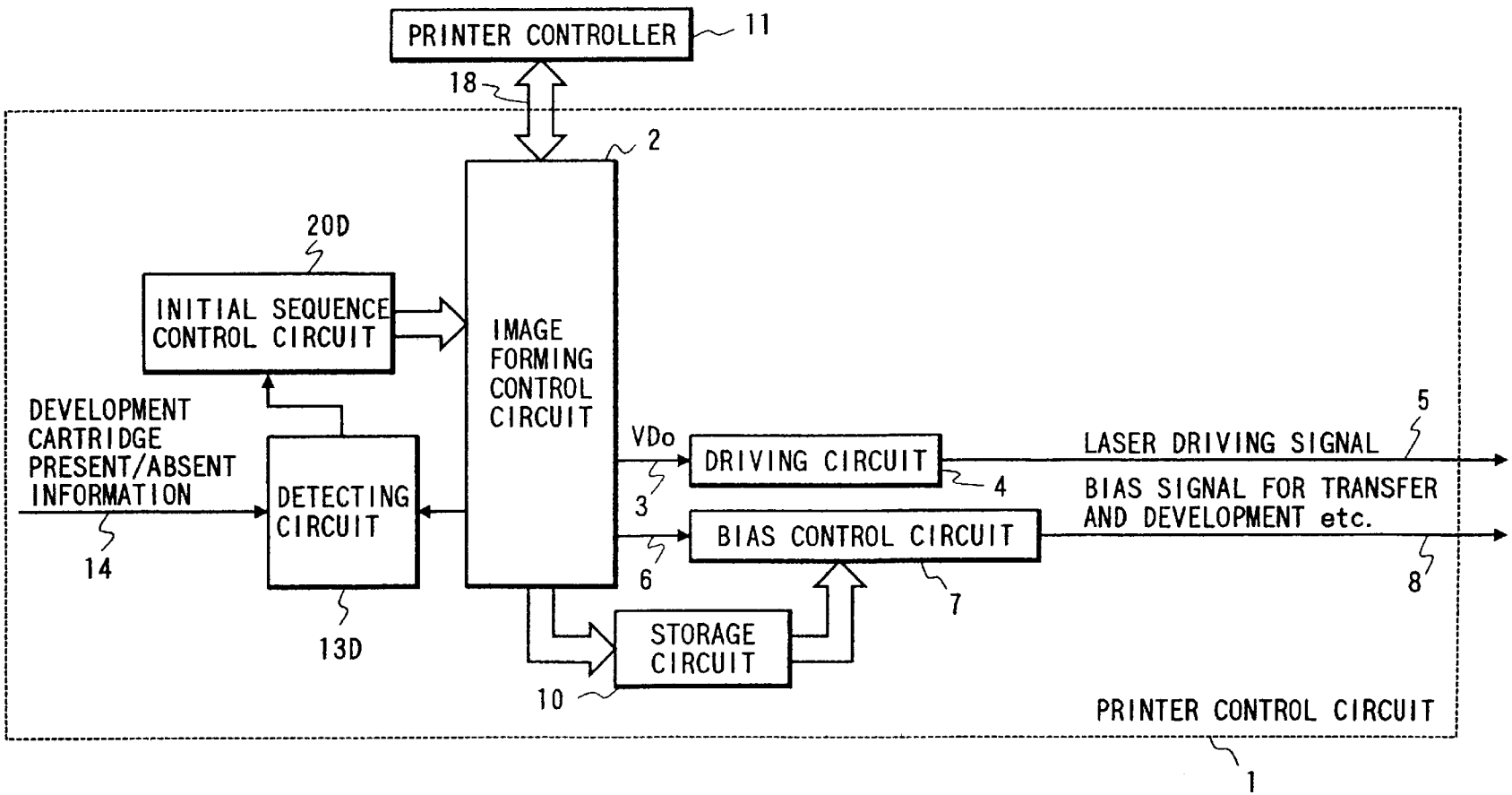
FIG. 10 PRIOR ART
FIG. 10 is a block diagram showing a control mechanism of a color printer which has conventionally been known.
Figure 11:
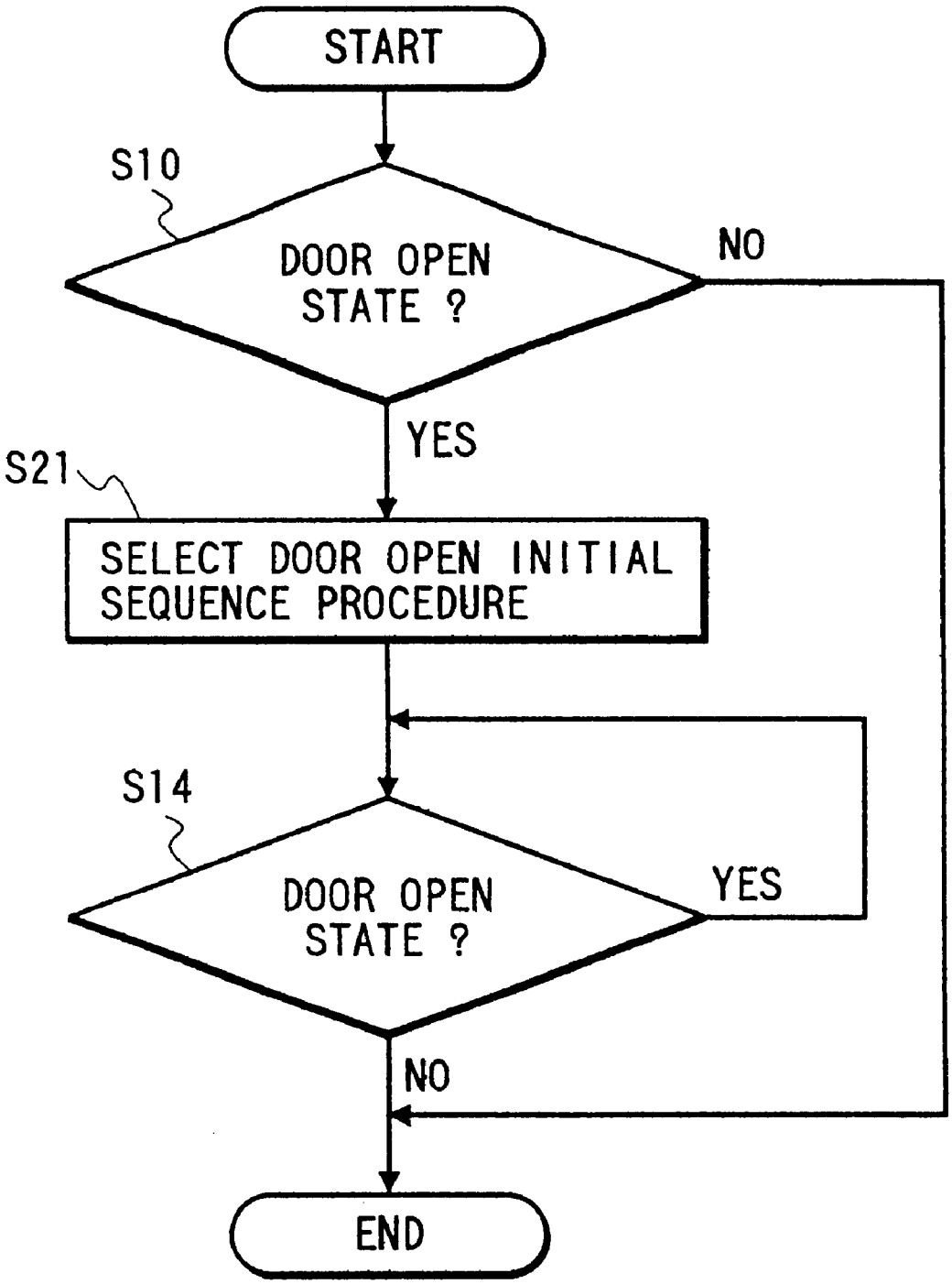
FIG. 11 PRIOR ART
FIG. 11 is a flowchart showing an initial sequence procedure of a printer shown in FIG. 10.

FIG. 1 is a block diagram for explaining a printer control mechanism of an image forming apparatus to which the invention is applied. The same component elements as those in FIG. 10 are designated by the same reference numerals. Six initial sequence procedures, which will be described in detail hereinlater with reference to FIG. 3, have been stored in an initial sequence table 9A.

In FIG. 1, when the power source is turned on, the printer control circuit 1 executes an initializing process of the image forming control circuit 2 such as turn-off of an output port connected to the image forming control circuit 2, a check of an abnormality of an input port of a sensor or the like, and the like. After that, the printer control circuit 1 starts the notification of an operation status of the printer to the printer controller 11 and the transmission and reception of commands from the printer controller 11 through the video I/F 18 and executes the initial process of a predetermined electrophotography process by, for example, an initial sequence procedure 1 (refer to FIG. 3) selected by an initial sequence control circuit 20A. A printing operation such as a character printing operation or the like can be performed at a time point when all of the processes are finished.

In this instance, each of the initial sequence procedures 1 to 6 has previously been stored in the table 9A and includes initial process items shown in FIG. 3. In FIG. 3, a mark "o" indicates that a process is executed and a mark "x" indicates that a process is not executed.

Ordinarily, the procedure 3 is selected when the power source is turned on and eight items shown in FIG. 3 (all RAM area clear execution, off time measurement execution, developer present/absent check drive, initial sleeve drive, photosensitive drum present/absent check drive, initial web drive, maximum image density Dmax control execution, and image density halftone control execution) are executed.

It takes a time of about three minutes which is required until the processes of eight items are finished.

The initial sequence procedure 2 is a process only when the door is opened or closed. In this case, it takes a time of about 20 to 30 seconds which is required until the process is finished.

The initial sequence control circuit 20A instructs the image forming control circuit 2 to select the initial sequence procedure on the basis of development cartridge remove information 15 detected by a detecting circuit 13A when the door is open.

Figure 2:
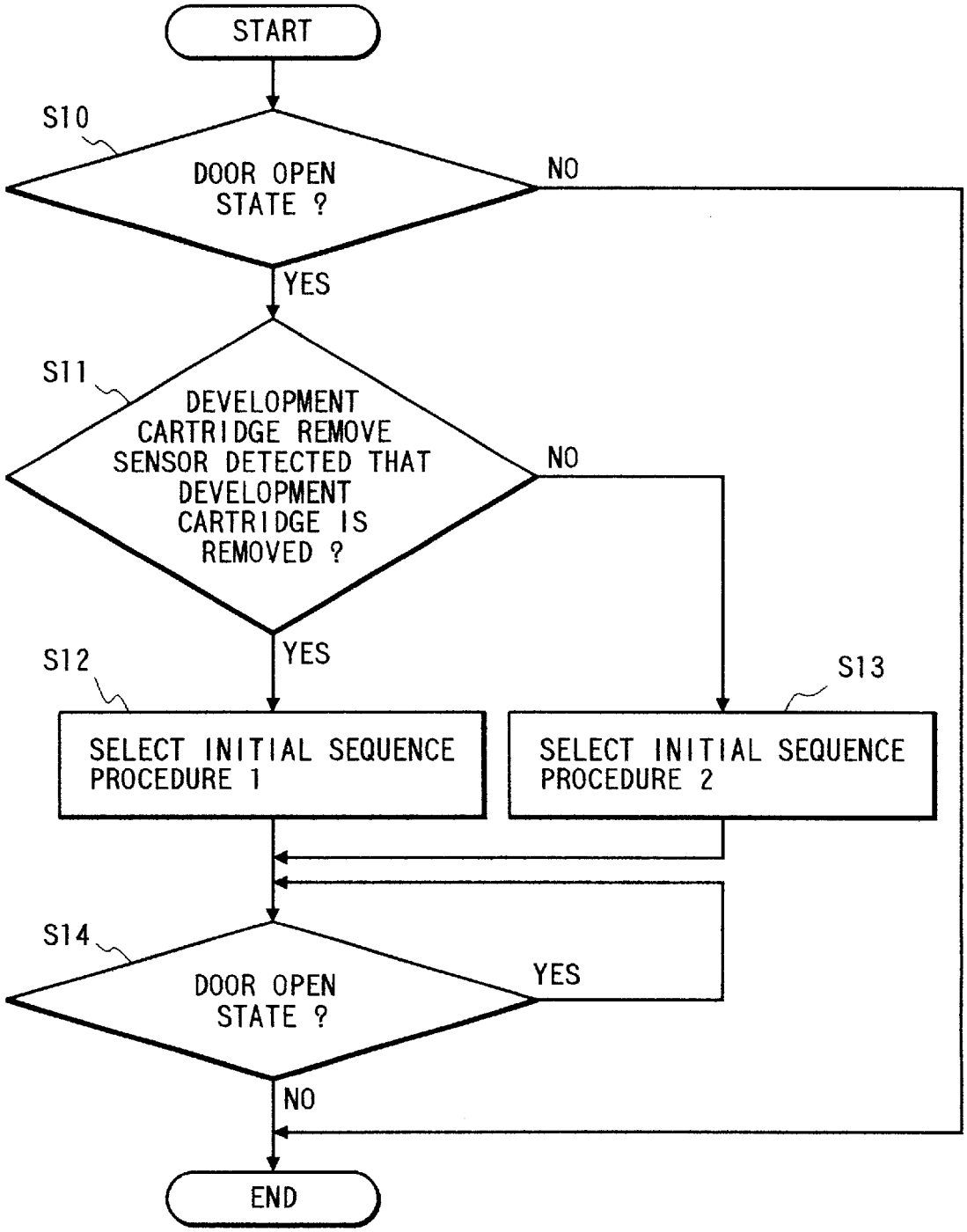
FIG. 2 is a flowchart showing an initial process in the first embodiment.

A processing procedure of the initial sequence control circuit 20A will now be sequentially described with reference to a flowchart of FIG. 2. First in step S10, a check is made to see if the door is open at present on the basis of an output of a door switch 19. If NO, the processing routine is finished. When it is judged that the door is open, step S11 follows and a check is made to see if the development cartridge remove sensor attached to a lever for removing the cartridge has detected the removal of the cartridge as information from the detecting circuit 13A, namely, whether an exchanging operation of the development cartridge has been performed or not. When it is judged that the removal of the cartridge was detected, step S12 follows and the image forming control circuit 2 is instructed so as to select the initial sequence procedure 1, namely, a process to perform a discrimination about the developer and a density control when the door is closed. When it is judged that the removal of the cartridge is not detected, step S13 follows and the image forming control circuit 2 is instructed so as to select the initial sequence procedure 2, namely, a process to skip the process about the developer and the density control process when the door is closed, and the apparatus waits until the door is closed (step S14). When the door is closed, the selected initial sequence is executed.

In the above embodiment, in case of executing the initial process on the basis of the door open/closed state, a process which should be executed at the time of the initial process can be known by detecting the developer operation (removal of the development cartridge), so that the initial time can be reduced.

Figure 4:
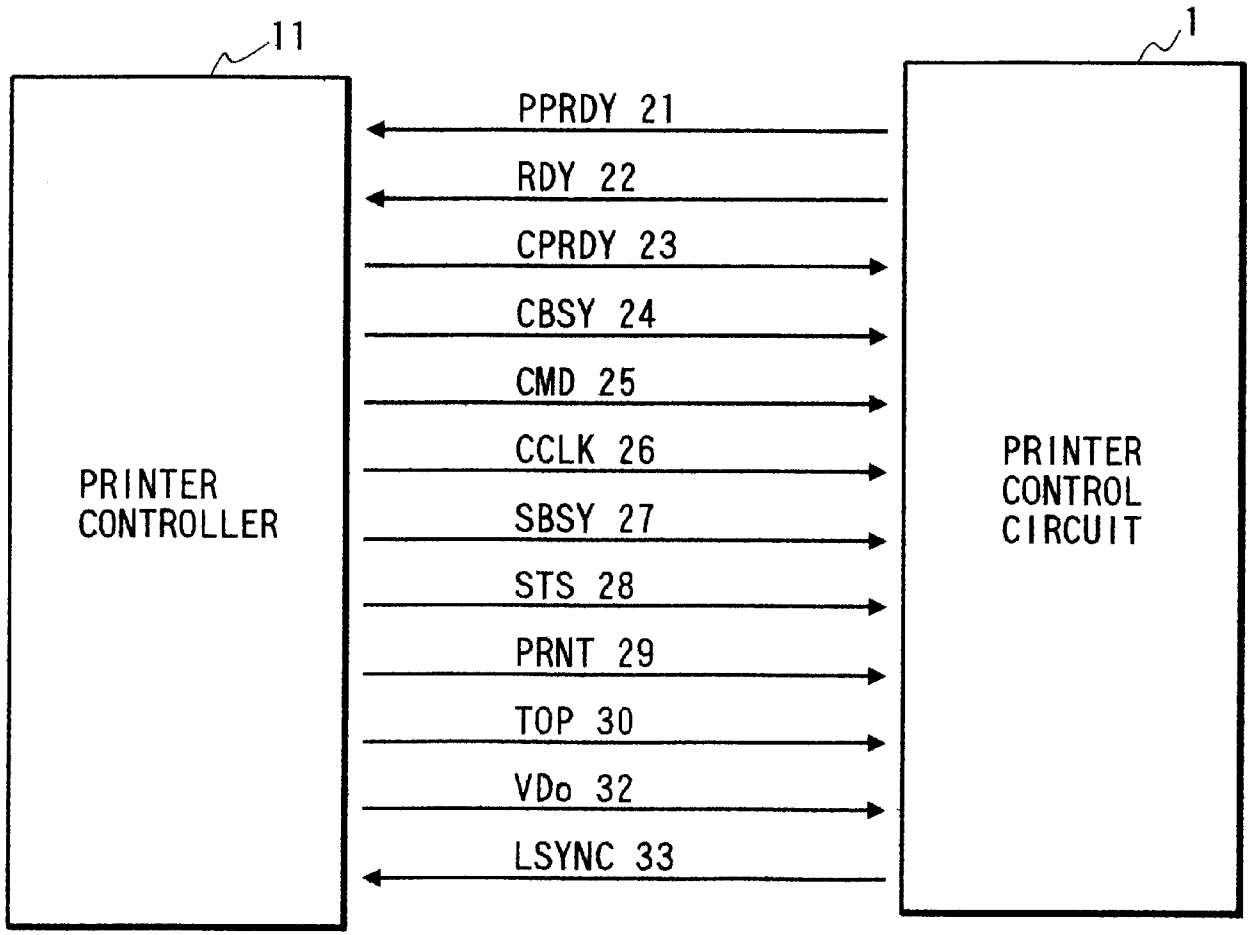
FIG. 4 is an explanatory diagram showing the operation between a printer controller and a printer control circuit.
Figures 5A, 5B:
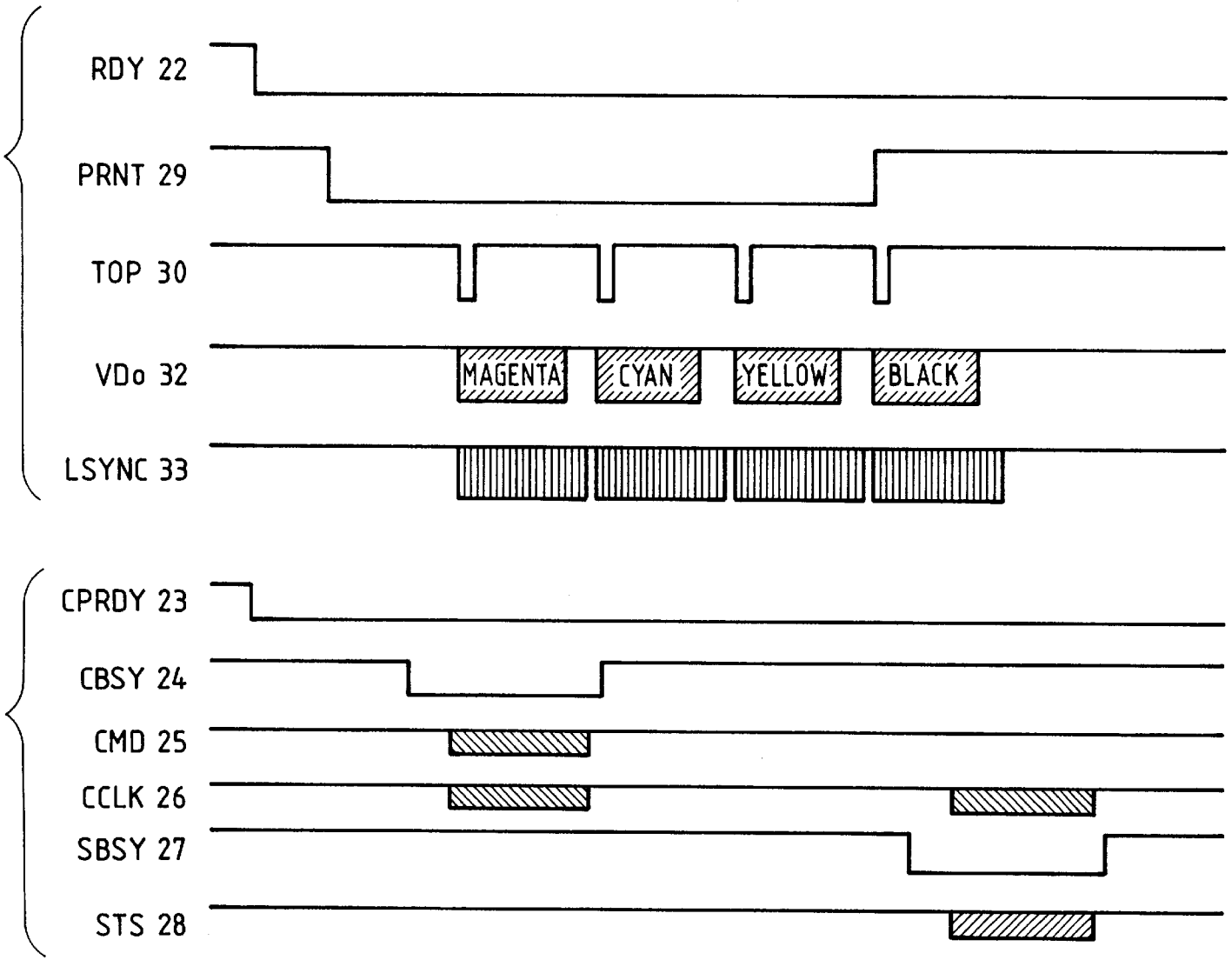
FIGS. 5A and 5B are explanatory diagrams showing the operation between the printer controller and the print control circuit.

The operation between the printer control circuit 1 and printer controller 11 will now be described with reference to FIGS. 4, 5A, and 5B. FIG. 4 shows interface signal lines for connecting the printer control circuit 1 and printer controller 11. Communication between printer control circuit 1 and printer controller 11 is performed using status flags PPRDY 21, RDY 22, CPRDY 23, CBSY 24, SBSY 27 and PRNT 29, as described in detail below. FIGS. 5A and 5B show timings of commands and statuses. The printer control circuit 1 sets PPRDY 21 to the low level at a time point when the communication with the printer controller 11 is enabled after the turn-on of the power source (in case of a low active). After it is confirmed that CPRDY 23 set by from the printer controller is at the low level, the image forming control circuit 2 starts a process to set the apparatus into a print enable state. When the apparatus enters the print enable state, RDY 22 is set to be the low level. On the other hand, the printer controller 11 sets CPRDY 23 to the low level at a time point when the communication is enabled as shown in FIG. 5B, and then sets CBSY signal 24 to the low level. After that, the printer controller 11 transmits a CMD signal 25 synchronously with a clock pulse (CCLK) 26. After the command by the CMD signal 25 is transmitted, the printer controller 11 sets the CBSY signal 24 to the high level. When receiving the command by the above-mentioned procedure, the printer control circuit 1 sets SBSY 27 to the low level and, after that, transmits an STS signal 28 synchronously with a clock pulse (CCLK) 26. After a status by the STS signal 28 is transmitted, the printer control circuit 1 sets an SBSY signal 27 to the high level.

By the above-mentioned procedures, the printer control circuit 1 and printer controller 11 perform the transmission and reception of the commands and statuses. A procedure for the printing operation will now be described.

The printer controller 11 confirms that the RDY signal 22 is at the low level and, after that, sets PRNT 29 to the low level. On the other hand, when it is confirmed that PRNT 29 is at the low level as shown in FIG. 5A, the printer control circuit 1 starts a pre-rotating operation of an electrophotography process. After an REJTOP signal (not shown) from the detecting circuit 13A was detected, the printer control circuit 1 generates a pulse of a TOP signal 30 after the elapse of time t1. The printer controller 11 generates an image signal VDo 32 of magenta synchronously with a pulse of an LSYNC signal 33 from the printer control circuit 1. By a similar procedure, the printer controller 11 generates image signals of cyan, yellow, and black and forms a multi-color image. The time t1 of each image signal in this instance has a value obtained by converting an attaching position deviation value of a sensor of each machine into a time and is set to a fixed value which was adjusted upon shipping.

Embodiment 2

Figure 6:
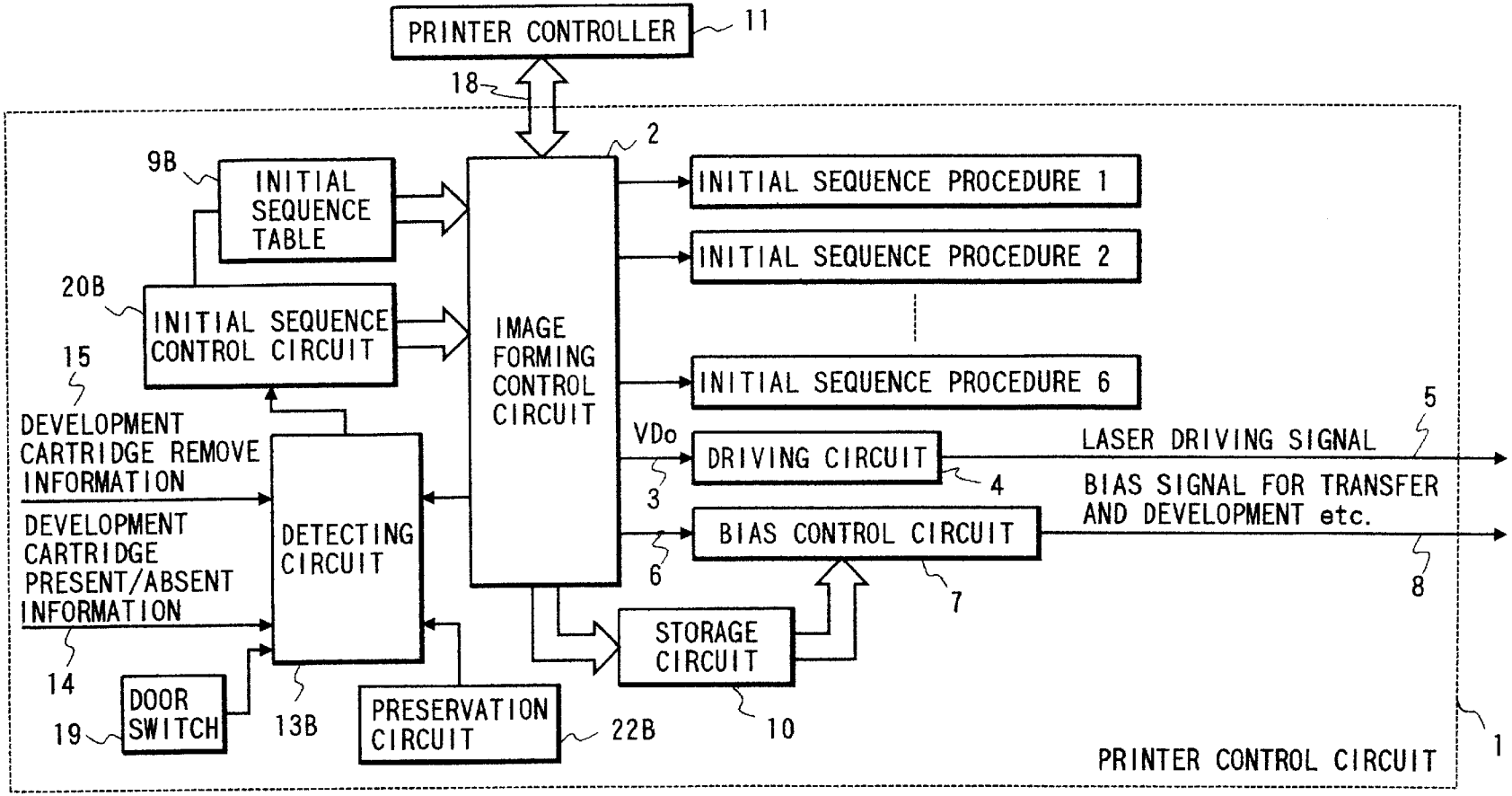
FIG. 6 is a block diagram showing the second embodiment of the invention.

The second embodiment of the invention will now be described hereinbelow with reference to FIG. 6. A construction of the printer control circuit 1 is substantially the same as that of the first embodiment except a point that detection information and the like from an initial sequence control circuit 20B and a detecting circuit 13B are made different. In the first embodiment, the door is opened in a state in which no development cartridge is mounted and, when the development cartridge is inserted, the removal of the developer cannot be judged by the information 15 by the development cartridge remove sensor. Conditions for the electrophotography process in a new developer are not optimum. In the second embodiment, therefore, as information to be judged by the initial sequence control circuit 20B, the development cartridge present/absent information 14 is preserved from the detecting circuit 13B into a preservation circuit 22B, and the initial sequence procedure is selected by also using the information from the preservation circuit 22B.

Figure 7:
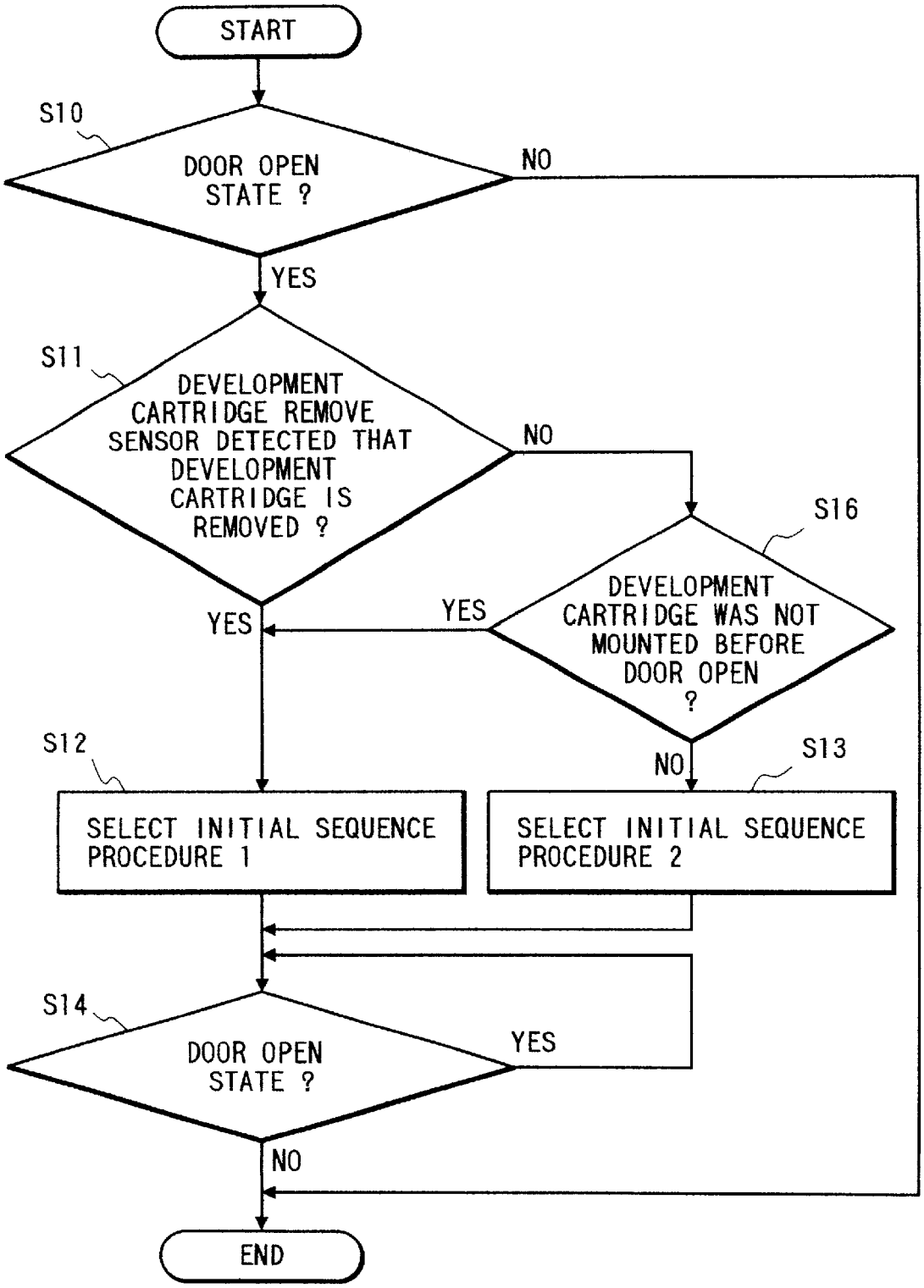
FIG. 7 is a flowchart showing an initial process in the second embodiment.

FIG. 7 shows a processing procedure of the initial sequence control circuit 20B in the second embodiment. In FIG. 7, the same processing steps as those in the first embodiment are designated by the same step numbers. First, a check is made to see whether the door is open at present or not by an output of the door switch 19 (step S10). If NO, the processing routine is finished. When it is judged that the door is open, step S11 follows and a check is made to see if the development cartridge remove sensor has detected the removal of the cartridge or not as information from the detecting circuit 13B, namely, whether the exchanging operation of the development cartridge has been performed or not. When it is judged that the removal of the cartridge is detected, step S12 follows and the image forming control circuit 2 is instructed so as to select the initial sequence procedure 1, namely, processes to perform a discrimination about the developer and a density control when the door is closed. When it is judged that the removal of the cartridge is not detected, step S16 follows.

In step S16, a check is made to see if the development cartridge was not mounted before the door is open or not as information from the preservation circuit 22B. If YES, step S12 follows. If it is judged that the cartridge has already been mounted, step S13 follows and the apparatus waits until the door is closed (step S14). When the door is closed, the selected initial sequence is executed.

According to the above embodiment, in the case where the door is opened at the preceding time in the state in which the development cartridge is not mounted and the development cartridge is inserted, whether the electrophotography processing conditions in the present developer are optimum or not can be judged by preserving and using the preceding cartridge present/absent information without providing a development cartridge inserting sensor Thus, the processes which should be executed at the time of the initial process can be known and the initial time can be reduced while assuring the picture quality.

Embodiment 3

Figure 8:
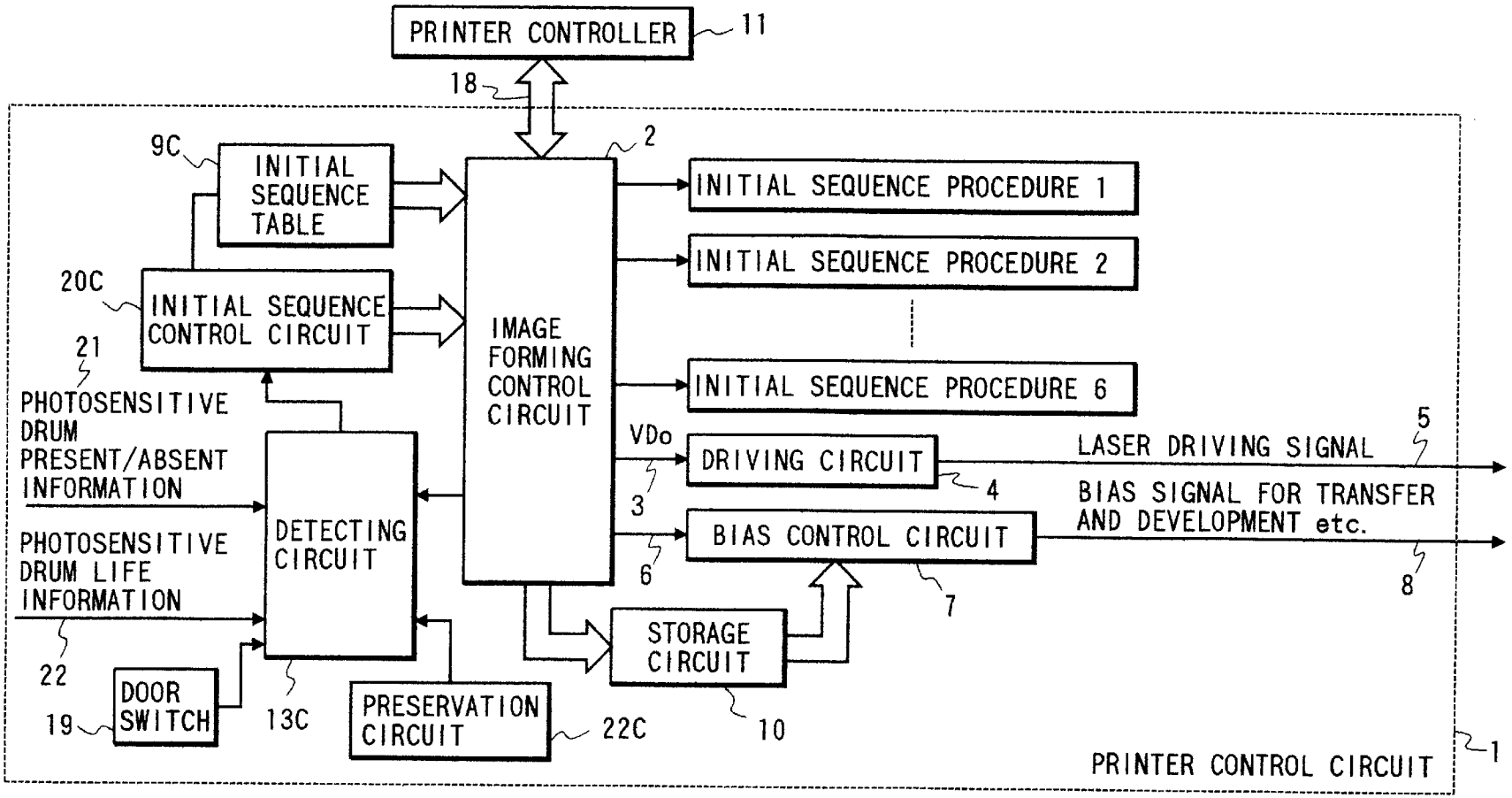
FIG. 8 is a block diagram showing the third embodiment of the invention.

The third embodiment of the invention will now be described hereinbelow with reference to FIG. 8. A construction of the printer control circuit 1 is substantially the same as that in the first embodiment except that detection information from an initial sequence control circuit 20C and a detecting circuit 13C and the like are made different. In the foregoing first and second embodiments, the development cartridge exchange information has been detected and the initial sequence procedure has been selected in order to reduce the initial time. Although the initial time can be extremely reduced by such a method, it is more preferable to further reduce the time.

Figure 9:
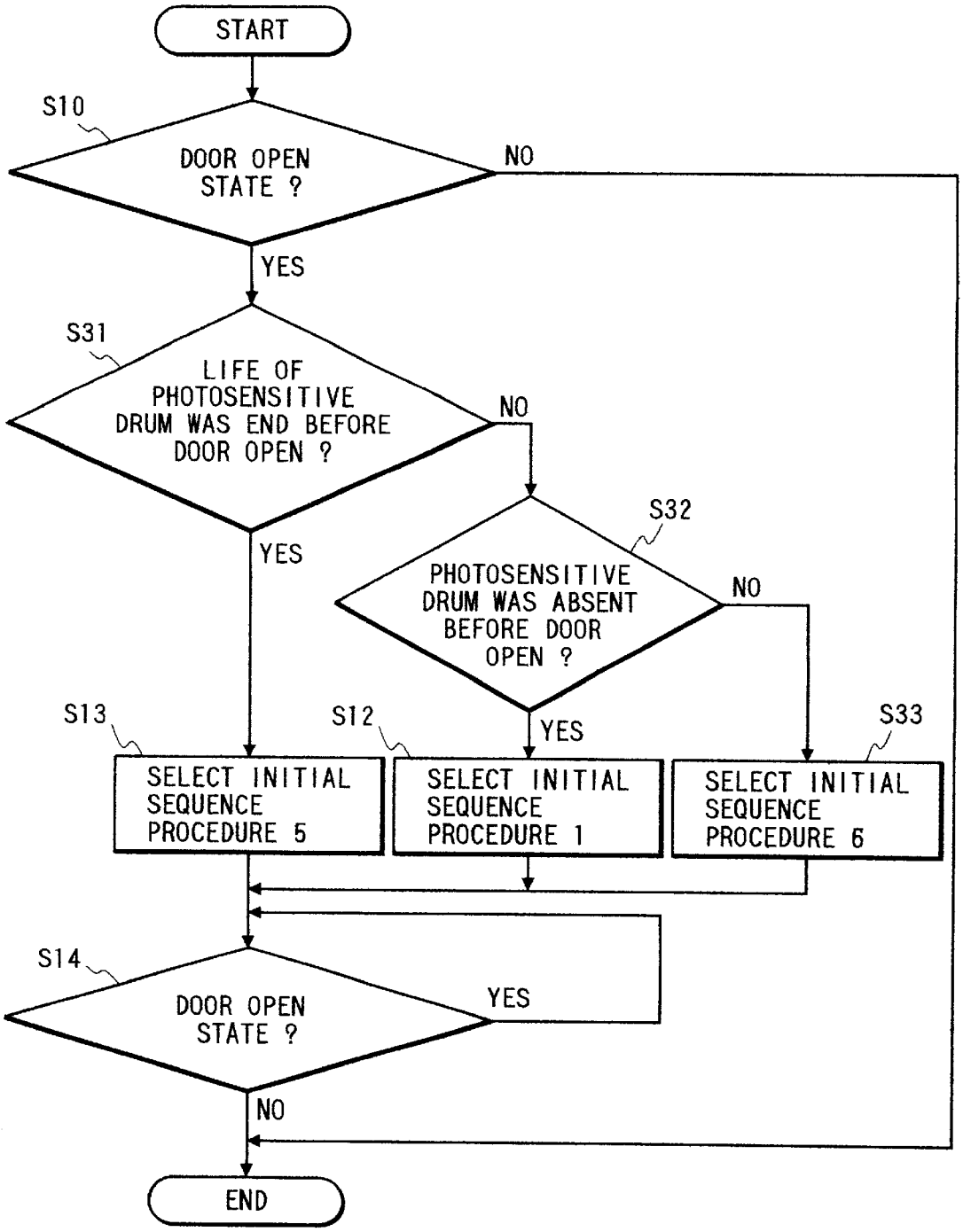
FIG. 9 is a flowchart showing an initial process in the third embodiment.

FIG. 9 shows a processing procedure of the initial sequence control circuit 20C in the third embodiment. In the embodiment, whether the initial photosensitive drum present/absent checking process shown in FIG. 3 is executed or not is decided. In the diagram, the same processing steps as those in the first embodiment are designated by the same step numbers. A fact that a life of a photosensitive material was ended and a fact that the photosensitive drum is not mounted are stored in a preservation circuit 22C. The life of the photosensitive material is detected by a well-known method.

A check is made to see if the door is now open on the basis of an output of the door switch 19 (step S10). If NO, the processing routine is finished. If YES, step S31 follows and a check is made to see whether the life of the photosensitive drum has been ended before the door is opened or not as information from the preservation circuit 22C. If YES, since an image density halftone control process is needed in order to assure the picture quality at upon initialization in the time of the door closed state, the initial sequence procedure 5 is selected (step S13). The apparatus waits until the door is closed (step S14). When the door is closed, the selected initial sequence is executed.

If the life is not ended, step S32 follows and a check is made to see whether the photosensitive drum was absent before the door is opened or not as information from the preservation circuit 22C. If YES, it is judged that the photosensitive drum was inserted, and the normal initial process in the door close state is selected (step S12). The apparatus waits until the door is closed (step S14). If the photosensitive drum existed, step S33 follows and the procedure 6 (step S33) as an initial sequence of the shortest time is selected and the apparatus waits until the door is closed (step S14). When the door is closed, the selected initial sequence is executed.

The initial sequence control circuit 20C compares the procedure 6 with the sequence procedure selected by the foregoing development cartridge operation information, instructs the sequence procedure of the greatest common measure as a decision sequence procedure to the image forming control circuit 2, and executes such a procedure at the time of the initial process when the door is closed.

According to the embodiment, the initial processing time can be minimized and whether the electrophotography processing conditions are optimum or not can be judged while assuring the picture quality.

Although not explained above, the initial sequence procedure 4 skips the initial process and allows the processes to be executed from a waiting state (refer to FIG. 3).

The present invention is not limited to the foregoing embodiments but many modifications and variations are possible within the spirit and scope of the appended claims of the invention.

What is claimed is:

1. An image forming apparatus comprising:

latent image forming means for forming a latent image onto a photosensitive material detachable from said image forming apparatus;

a developing device detachable from said image forming apparatus for developing said latent image formed on said photosensitive material;

first detecting means for detecting whether or not said photosensitive material or said developing device is removed from or mounted to said image forming apparatus in an open state of a door provided for said image forming apparatus;

second detecting means for detecting an open or closed state of the door;

storage means for storing a plurality of initial sequence procedures, each of which includes items of an initial sequence to be executed, wherein said storage means stores at least a first initial sequence procedure which includes specific items for controlling an image density formed by said latent image forming means and said developing device and a second initial sequence procedure which does not include the specific items;

selecting means for selecting the first initial sequence procedure if it is detected by said first detecting means that said photosensitive material or said developing device is removed or mounted, and for selecting the second initial sequence procedure if it is not detected by said first detecting means that said photosensitive material or said developing device is removed or mounted; and control means for causing said image forming apparatus to execute an initial sequence in accordance with the initial sequence procedure selected by said selecting means when it is detected by said second detecting means that the door is closed from the open state.

2. An apparatus according to claim 1, wherein said storage means stores a third initial sequence procedure including items of an initial sequence which are executed when a power source is supplied to said image forming apparatus.

3. An apparatus according to claim 1, wherein the specific items for controlling the image density are items for controlling a maximum density.

4. An apparatus according to claim 1, wherein the specific items for controlling the image density are items for controlling a halftone density.

5. An image forming apparatus comprising:

image forming means including a removable processing cartridge for forming an image;

first detecting means for detecting whether or not said processing cartridge is removed from or mounted to said image forming apparatus in an open state of a door provided for said image forming apparatus;

second detecting means for detecting an open or closed state of the door;

storage means for storing a plurality of initial sequence procedures, each of which includes items of an initial sequence to be executed, wherein said storage means stores at least a first initial sequence procedure which includes specific items for controlling an image density formed by said image forming means and a second initial sequence procedure which does not include the specific items;

selecting means for selecting the first initial sequence procedure if it is detected by said first detecting means that the processing cartridge is removed or mounted, and for selecting the second initial sequence procedure if it is not detected by said first detecting means that said processing cartridge is removed or mounted; and control means for causing said image forming apparatus to execute an initial sequence in accordance with the initial sequence procedure selected by said selecting means when it is detected by said second detecting means that the door is closed from the open state.

6. An apparatus according to claim 5, wherein the specific items for controlling the image density are items for controlling a maximum density.

7. An apparatus according to claim 5, wherein the specific items for controlling the image density are items for controlling a halftone density.

8. An apparatus according to claim 5, further comprising preserving means for preserving mounting state data representing whether or not said processing cartridge has been mounted before said door is opened, and wherein said selecting means selects the initial sequence procedure to be executed, on the basis of the mounting state data preserved by said preserving means and the detecting result of said first detecting means.

9. A control method of an image forming apparatus, comprising the steps of:

a) detecting whether a door provided for said image forming apparatus is open or closed;

b) detecting whether or not a photosensitive material or a developing device is removed or mounted to said image forming apparatus if said door is open;

c) storing a plurality of initial sequence procedures, each of which includes items of an initial sequence to be executed, wherein said storing step stores at least a first initial sequence procedure which includes specific items for controlling an image density formed by a latent image forming device and said developing device and a second initial sequence procedure which does not include the specific items;

d) selecting the first initial sequence procedure if it is detected that said photosensitive material or said developing device is removed or mounted in accordance with the detection result in said step (b), and for selecting the second initial sequence procedure if it is not detected that said photosensitive material or said developing device is removed or mounted, and controlling said image forming apparatus to execute an initial sequence in accordance with the initial sequence procedure selected by said selecting step when it is detected that the door is closed in said step (a).

10. A method according to claim 9, wherein said storing step stores a third initial sequence procedure including items of an initial sequence to be executed when a power source of said image forming apparatus is turned on.

11. A method according to claim 9, wherein the specific items for controlling the image density are items for controlling a maximum density.

12. A method according to claim 9, wherein the specific items for controlling the image density are items for controlling a halftone density.

13. A control method of an image forming apparatus, comprising the steps of:

a) detecting whether a door provided for said image forming apparatus is open or closed;

b) detecting whether a removable processing cartridge for forming an image of said image forming apparatus has been removed or closed if said door is open;

c) storing a plurality of initial sequence procedures, each of which includes items of an initial sequence to be executed, wherein said storing step stores at least a first initial sequence procedure which includes specific items for controlling an image density formed by said removable processing cartridge and a second initial sequence procedure which does not include the specific items;

d) selecting the first initial sequence procedure if it is detected that said removable processing cartridge is removed or mounted in accordance with the detection result in said step (b), and for selecting the second initial sequence procedure if it is not detected by said detecting in said step (b) that said removable processing cartridge is removed or mounted; and controlling said image forming apparatus to execute an initial sequence in accordance with the initial sequence procedure selected by said selecting step when it is detected that the door is closed in said step (a).

14. A method according to claim 13, wherein the specific items for controlling the image density are items for controlling a maximum density.

15. A method according to claim 13, wherein the specific items for controlling the image density are items for controlling a halftone density.

16. A method according to claim 13, further comprising the step of (d) detecting whether or not said processing cartridge has been mounted before said door is opened, and wherein said step (d) selects the first or second initial sequence procedure to be executed, on the basis of the detection results of said steps (a) and (b).

* * * * *

UNITED STATES PATENT AND TRADEMARK OFFICE

CERTIFICATE OF CORRECTION

PATENT NO. : 6,304,334 B1
DATED : October 16, 2001
INVENTOR(S) : Fumihiro Ueno

It is certified that error appears in the above-identified patent and that said Letters Patent is hereby corrected as shown below:

Title page,
Item [56] References Cited, FOREIGN PATENT DOCUMENTS,
"2234177" should read -- 2-234177 -- and
"06208263" should read -- 6-208263 --.

Column 1,
Line 9, "a n" should read -- an --; and
Line 18, "form ed" should read -- formed --.

Column 4,
Line 28, "from" should be deleted; and
Line 35, "signal" should be deleted.

Column 8,
Line 34, "mounted, and" should read -- mounted; and --; and
Line 55, "closed" should read -- mounted --.

Signed and Sealed this

Twenty-eighth Day of May, 2002

*Attest:*

*Attesting Officer*

JAMES E. ROGAN
*Director of the United States Patent and Trademark Office*